United States Patent [19]

Salmon

[11] Patent Number: 4,683,679

[45] Date of Patent: Aug. 4, 1987

[54] GRINDING AND DRESSING WHEEL SUPPORT AND RELEASE APPARATUS

[76] Inventor: Stuart C. Salmon, P.O. Box 40469, Cincinnati, Ohio 45240

[21] Appl. No.: 816,411

[22] Filed: Jan. 6, 1986

[51] Int. Cl.[4] ..... B24B 45/00; B24B 53/04

[52] U.S. Cl. ..... 51/5 D; 51/168; 51/281 R; 125/11 C D

[58] Field of Search ..... 29/568; 51/168.5 D, 51/131.2, 131.3, 281 R; 125/11 C D; 82/31

[56] References Cited

U.S. PATENT DOCUMENTS

| | | | |
|---|---|---|---|
| 1,918,392 | 7/1933 | Hohnhorst et al. | 51/168 |
| 1,937,459 | 11/1933 | Hill | 51/131.2 |
| 2,396,399 | 3/1946 | Veale | 82/31 |
| 2,470,282 | 5/1949 | Baker | 51/168 |
| 2,546,684 | 3/1951 | Ashton | 82/31 |
| 2,653,503 | 9/1953 | Cormier | 82/31 |
| 2,940,224 | 6/1960 | Medrich | 51/131.3 |
| 3,646,708 | 3/1972 | Jones | 125/11 C D |
| 4,073,281 | 2/1978 | Asaeda et al. | 125/11 C D |
| 4,557,077 | 12/1985 | Kolb . | |
| 4,557,078 | 12/1985 | Brill . | |
| 4,559,919 | 12/1985 | Kushigian . | |

OTHER PUBLICATIONS

Blohm HFS, Precision Horizontal Surface and Profile Grinding Machines.

ELB-SCHLIFF, Grinding Technology.

Schaudt, External Cylindrical Grinding Machines E450N, E550N.

KW-Aufnahmegerate, for Diamantabrichtrollen Units for Diamond Dressing Rollers.

Hauni-Blohm, Grinding Machines.

Ex-Cell-O England, Special Purpose, Fine Boring & Transfer Machines.

*Primary Examiner*—Harold D. Whitehead

*Attorney, Agent, or Firm*—Jacox & Meckstroth

[57] ABSTRACT

Grinding and dressing wheel support and release apparatus adapted to maintain a high degree of accuracy and adapted for quick change of a grinding wheel and dressing roll. A grinding wheel unit is maintained between two axially aligned shafts for rotation therewith. One shaft is axially movable to permit ease of replacement of the grinding wheel unit. Mechanism is provided for sensing the axial position of the axially movable shaft and for control of the axial position of the axially movable shaft. A dressing roll structure has a dressing roll engageable with the grinding wheel. The dressing roll structure preferably has the same type of shaft support as the grinding wheel structure. Mechanism is provided for automatic removal and replacement of the grinding wheel and/or dressing roll. Mechanism is provided for automatically maintaining the dressing roll in engagement with the grinding wheel for continuous dressing of the grinding wheel.

8 Claims, 10 Drawing Figures

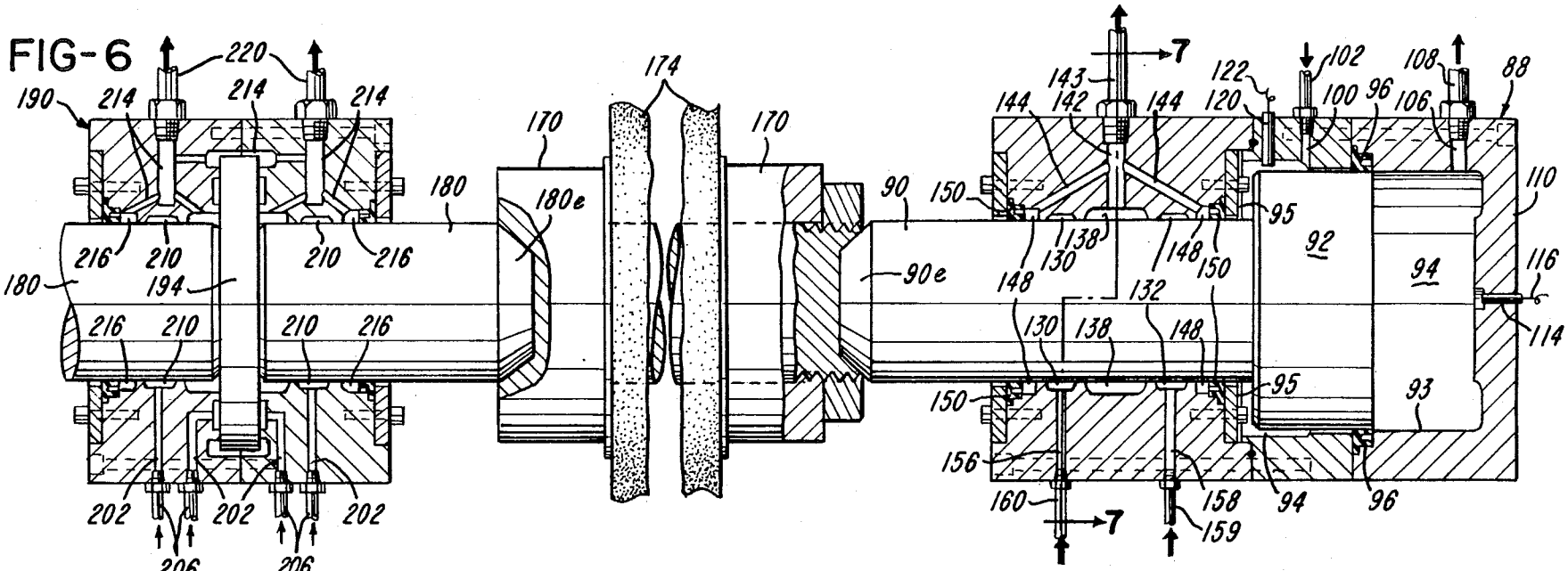
FIG-6
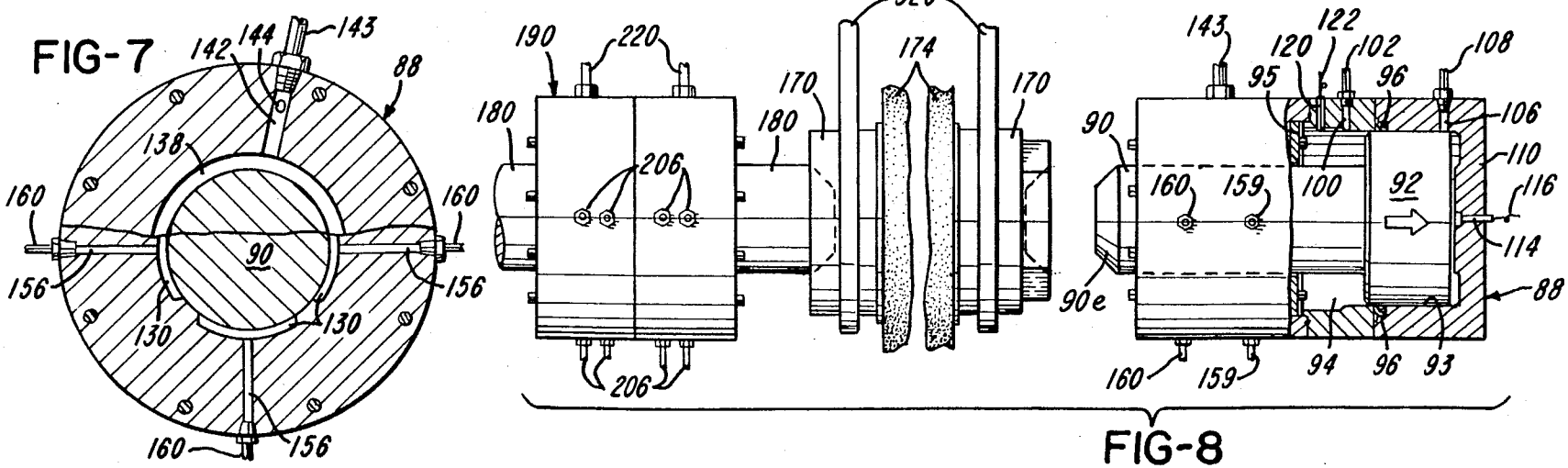
FIG-8
FIG-7

GRINDING AND DRESSING WHEEL SUPPORT AND RELEASE APPARATUS

BACKGROUND OF THE INVENTION

In the past, abrasive grinding wheels generally have been supported upon a shaft in a cantilever fashion. This arrangement has made it possible to easily and readily change the grinding wheels as such changes are required for good grinding operation.

However, such a cantilever type of support arrangement for grinding wheels results in inaccuracies in the grinding operation, due to the fact that the cantilever support permits flexing of the shaft which supports the grinding wheel. Thus, a grinding operation has frequently lacked good quality, particularly during high stock removal creep-feed grinding.

A dressing roll structure for grinding wheels usually includes a two bearing housing arrangement, in which the dressing roll is supported between the two bearings. However, conventional rolling contact bearings become worn. Shaft runout and vibration occurs. Thus, accuracy of dressing operation is not maintained.

Continuous dress creep-feed grinding requires the dressing roll to rotate at speeds higher than normal. Therefore, the resolution of the dressing roll position with respect to the grinding wheel is critical to the success of the grinding process. In other words, the rate of travel of the dressing roll into the grinding wheel is critical for high performance grinding.

It is an object of this invention to provide a structure by which shafts which support a grinding wheel and a dressing roll are rigidly supported to maintain a high degree of resolution in the grinding operation and in which shaft wear is a minimum.

It is another object of this invention to provide such structure in which the grinding wheel and dressing roll can be quickly, easily, and readily removed and replaced.

Another object of this invention is to provide such structure by which the grinding wheel and dressing roll can be removed and replaced by an automatically operable mechanism, such as by robotic mechanism or the like.

Another object of this invention is to provide grinding and dressing structure which is suitable for high speed operation in a process of continuous dressing.

Other objects and advantages of this invention reside in the construction of parts, the combination thereof, and the mode of operation, as will become more apparent from the following description.

SUMMARY OF THE INVENTION

This invention comprises means and methods for accurately maintaining a grinding wheel and a dressing roll in proper positions and in proper conditions for grinding. This invention also comprises means for supporting a grinding wheel and a dressing roll in a manner by which the grinding wheel and dressing roll can be easily and speedily removed and replaced. This invention also includes means by which a grinding wheel and a dressing roll can be removed and replaced by automatically operable mechanisim.

In the structure of this invention, the grinding wheel and the dressing roll are supported upon mandrels. Each mandrel is supported between a pair of axially aligned shaft members. Each shaft member is supported by hydro-static bearings. One shaft member in each pair of shaft members is axially movable to clamp and to release the mandrel which is supported between the pair of shafts.

Herein hydraulic fluid is employed in axial movement of each axially movable shaft.

Also, herein, means are included for sensing the axial position of each axially movable shaft. Therefore, the mandrel which supports a grinding wheel or dressing roll between a pair of shafts can be automatically removed and replaced.

BRIEF DESCRIPTION OF THE VIEWS OF THE DRAWINGS

FIG. 6 is an enlarged fragmentary sectional view taken substantially on line 6—6 of FIG. 2.

FIG. 7 is a sectional view taken substantially on line 7—7 of FIG. 6.

FIG. 8 is a view, similar to FIG. 6, but with parts shown in elevation and in section and broken away, and drawn on a smaller scale than FIG. 6, illustrating the position of elements of the apparatus during a step in removal of the grinding wheel.

DETAILED DESCRIPTION OF THE PREFERRED EMBODIMENT

Figure 1:
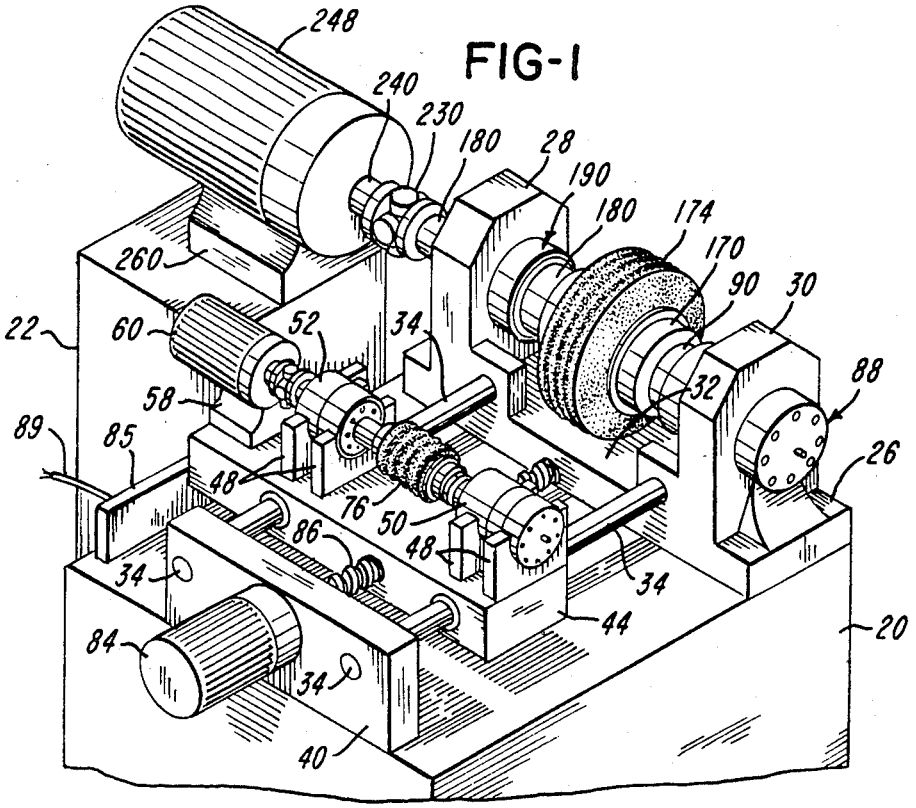
FIG. 1 is a perspective view of a grinding wheel and dressing roll apparatus of this invention. This view shows the dressing roll in spaced relationship from the grinding wheel.

FIG. 1 shows a grinding and dressing apparatus of this invention. A solid heavy rigid base 20 supports a major portion of the apparatus. A solid heavy rigid base 22 supports another portion of the apparatus.

Upon the base 20 is a support member 26 which includes spaced-apart bearing pedestals 28 and 30. Between the pedestals 28 and 30 is an intermediate portion 32.

Attached to the support member 26 and extending therefrom are parallel spaced-apart ways 34, which are preferably, hydro-static ways. The hydro-static ways 34 are also attached to a block 40, which is attached to the base 20.

Supported upon the hydro-static ways 34 is a carriage 44. Upon the carriage 44 are sets of spaced-apart bearing support members 48. Supported upon one set of bearing support members 48 is a bearing housing 50. Supported upon another set of bearing support members 48 is a bearing housing 52. A pedestal 58 adjacent the bearing housing 52 supports a rotary motor 60. The motor 60 has a shaft 62 extending therefrom. A coupling 66 joins the shaft 62 to a shaft 68 which extends through the bearing housing 52.

The shaft 68 has an end thereof in engagement with a mandrel 70. Mounted upon the mandrel 70 is a dressing roll 76. Also engaging the mandrel 70 is a shaft 80 which extends from the bearing housing 50 and which is supported within the bearing housing 50.

Supported upon the block 40 is a rotary motor 84. Attached to the rotary motor 84 for rotation thereby is a screw shaft 86, which is preferably a ball-screw shaft. The screw shaft 86 is threadedly joined to the carriage 44 and extends through the carriage 44.

Figure 2:
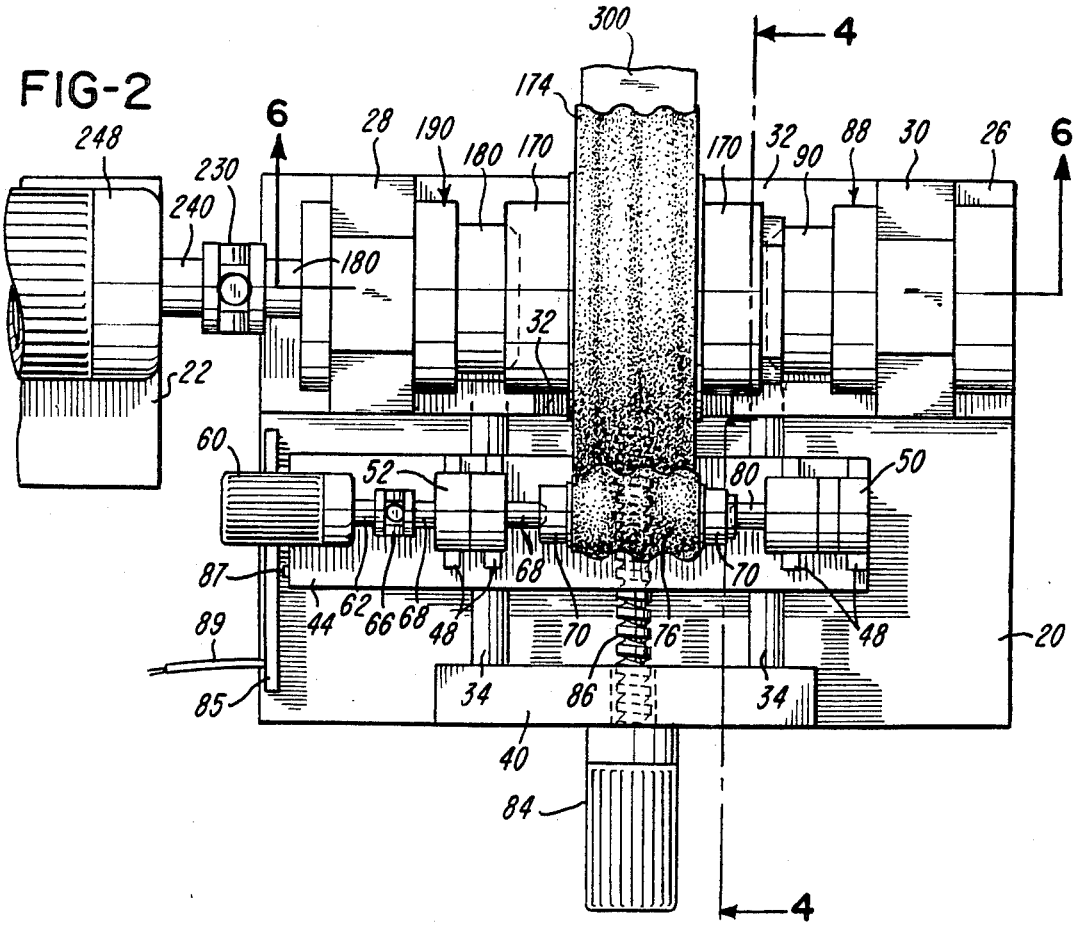
FIG. 2 is a fragmentary top plan view, drawn on a larger scale than FIG. 1, and showing the dressing roll in engagement with the grinding wheel.
Figure 3:
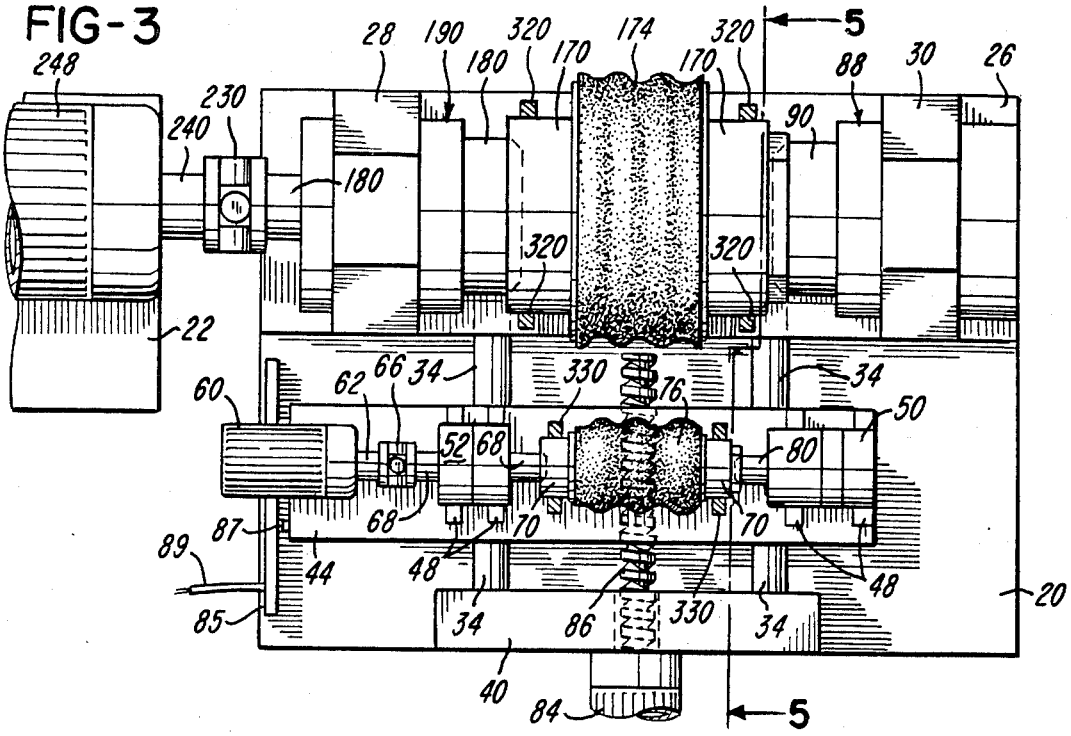
FIG. 3 is a top plan view, similar to FIG. 2, and drawn on substantially the same scale as FIG. 2, and showing the dressing roll spaced from the grinding wheel. This view also illustrates means for removing the grinding wheel and the dressing roll.
Figure 4:
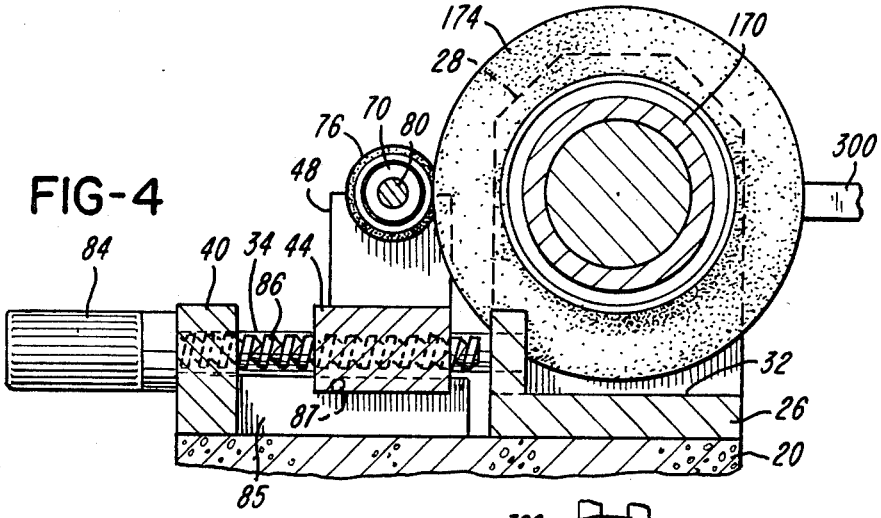
FIG. 4 is a sectional view taken substantially on line 4—4 of FIG. 2.

As shown in FIGS. 1, 2, and 3, upon the base 20 adjacent the carriage 44 is an elongate sensor member 85. Carried by the carriage 44 adjacent the sensor member 85 is an indicator element 87. The sensor member 85 senses the position of the indicator element 87. Electric conductor members 89 extend from the sensor member 85 to a control unit, not shown.

Mounted within the pedestal 30 is a bearing housing 88. As best shown in FIG. 6, rotatably mounted within bearing housing 88 is a shaft 90 which is provided with a piston 92. The piston 92 is positioned within a chamber 94. An annular shoulder 95 forms an inner wall of the chamber 94. The piston 92 is encompassed by an annular elastomeric sealing member 96, which seals between the piston 92 of a cylindrical wall 93 of the chamber 94. A fluid passage 100 is in communication with the chamber 94 at one side of the sealing member 96. A conduit 102 is joined to the bearing housing 88 in communication with the passage 100.

A fluid passage 106 is in communication with the chamber 94 on the opposite side of the sealing member 96. A conduit 108 is joined to the bearing housing 88 and is in communication with the fluid passage 106.

The bearing housing 88 has an end wall 110 within which is mounted a proximity sensor element 114. An electrical conductor 116 is attached to the proximity sensor element 114 and extends therefrom to any suitable control unit, not shown. A proximity element 120 is mounted in the bearing housing 88 adjacent the shoulder 95. An electric conductor 122 is connected to the proximity element 120.

The portion of the internal wall of the bearing housing 88 which supports the shaft 90 is provided with an annularly arranged series of recesses 130 and an annularly arranged series of recesses 132. Between the series of recesses 130 and 132 is an annular exhaust flow passage 138. A radial exhaust passage 142 is joined to the annular exhaust flow passage 138. A conduit 143 is attached to the housing 88 and is in communication with the passage 142. A plurality of exhaust passages 144 connect to the radial exhaust passage 142 and to annular relief passages 148 in the bearing housing 88. Adjacent the annular relief passages 148 are annular sealing members 150 which are mounted in the housing 88 and engage the shaft 90. A radial inlet passage 156 leads to each recess 130. A conduit 160 is joined to the housing 88 and is in communication with each passage 156. Preferably, there is one conduit 160 for each recess 130, a radial inlet passage 158 for each recess 132. A conduit 159 is connected to each passage 158.

The shaft 90 has a tapered end portion **90*e* which is in engagement with an end of a mandrel 170. A grinding wheel 174 is attached to the mandrel 170**.

A shaft 180 has a tapered end **180*e* which is in engagement within the opposite end of the mandrel 170. The shaft 180 is supported within a bearing housing 190. The bearing housing 190 is supported within the pedestal 28. The shaft 180 has a thrust collar 194 which is positioned within the bearing housing 190. Passages 202 and conduits 206 lead to recesses and passages 210 which are within the housing 190 adjacent the thrust collar 194 and adjacent the shaft 180. Exhaust passages 214 are also adjacent the thrust collar 194. The exhaust passages 214 also lead from fluid flow regions 216 adjacent the cylindrical surface of the shaft 180. Conduits 220 lead from the passages 214**.

A coupling 230 attaches the shaft 180 to a shaft 240 of a rotary motor 248. The motor 248 is mounted upon a pedestal 260 which is attached to the rigid base 22.

Grinding and Dressing Operation

FIG. 2 illustrates the positions of the grinding wheel 174 and the dressing roll 76 for continuous dressing of the grinding wheel 174. The motor 248 is energized and rotates the grinding wheel 174, through the shaft 180 and the mandrel 170. The shaft 90 also supports the grinding wheel 174, through the mandrel 170.

As shown in FIG. 6, the shaft 180 is rotatably supported in the bearing housing 190. A fluid is forced into the bearing housing 190 through the conduits 206. The shaft 180 is therefore supported by high pressure fluid, as the fluid flows within the passages and recesses 210. The fluid flows outwardly from the bearing housing 190 through the passages 214 and through the conduits 220.

The shaft 90 is lubricated and supported within the bearing housing 88 as fluid flows into the housing 88 through the conduits 160 and 159. The fluid flows from the housing 88 through passages 144 and 142, and through the conduit 143.

The shaft 90 is maintained in engagement with the mandrel 170 as fluid is forced into the chamber 94 through the conduit 108 and the passage 106. Thus, the piston 92 and the shaft 90 are urged toward the mandrel 170.

In order to move the dressing roll 76 into engagement with the grinding wheel 174, the motor 84 is energized for rotative movement of the screw shaft 86. Rotative movement of the screw shaft 86 moves the carriage 44 upon the hydro-static ways 34. Thus, the dresssing roll 76 is moved into engagement with the grinding wheel 174. The motor 60 is energized and rotates the shaft 68, which rotates the mandrel 70, the dressing roll 76 and the shaft 80.

The structure within the bearing housing 52 is similar to the structure within the bearing housing 190. The structure within the bearing housing 50 is similar to the structure within the bearing housing 88. Thus, the shaft 80 is maintained in engagement with the mandrel 70 by fluid within the bearing housing 50 which urges a piston, not shown, and the shaft 80 toward the mandrel 70.

The grinding wheel 174 is shown in engagement with a workpiece 300. As the grinding wheel 174 operates upon the workpiece 300, the dressing roll 76 is, preferably, maintained in engagement with the grinding wheel 174 for continuous dressing of the grinding wheel 174. The screw shaft 86 is rotated by the motor 84. Thus, the carriage 44 is moved toward the grinding wheel 174. Therefore, the dressing roll 76 is moved into the grinding wheel 174. Therefore, the diameter of the grinding wheel is reduced as a result of the infeed of the dressing roll 76. As the dressing roll 76 operates upon the grinding wheel 174, the dressing roll 76 removes material from the grinding wheel 174. The amount of reduction of the diameter of the grinding wheel 174 with each revolution of the grinding wheel 174 as the dressing roll 76 operates upon the grinding wheel 174 is known. The motor 84 rotates the screw shaft 86 to move the carriage 44 and the dressing roll 76 into the grinding wheel 174. This movement is in accordance with given input data, related to the amount of material removed from the grinding wheel 174 by the dressing roll 76. The sensor member 85 senses the position of the indicator element 87 and thus senses the position of the carriage 44. Through the conductor members 89 and the control unit, not shown, the motor 84 is operated to rotate the screw shaft 86 and to move the carriage 44 and the dressing roll 76 toward the grinding wheel 174, in accordance with the input data.

Removal and Replacement of the Grinding Wheel and Dressing Roll

When it is desired to remove the grinding wheel 174 and/or the dressing roll 76, the motors 248 and 60 are deenergized to stop rotation thereof. Then the motor 84 is energized for rotation of the screw shaft 86 for moving the carriage 44 in a direction away from the grinding wheel 174. Thus, the dressing roll 76 is moved to a position spaced from the grinding wheel 174, as illustrated in FIG. 3.

Figure 5:
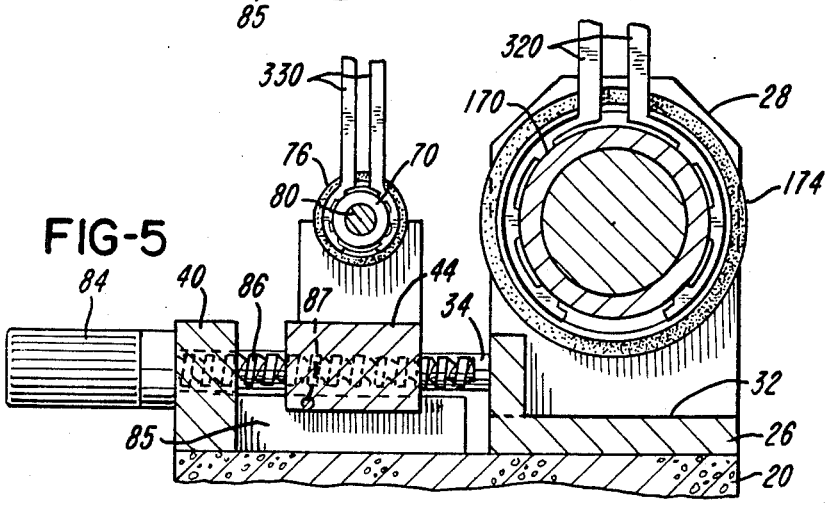
FIG. 5 is a sectional view taken substantially on line 5—5 of FIG. 3.

Preferably, mechanical and electrical means are employed for moving the grinding wheel 174 and/or the dressing roll 76 out of operating position and into operating position. When the dressing roll 76 is positioned in spaced relationship from the grinding wheel 174, as illustrated in FIGS. 3 and 5, grasping elements 320 are brought into grasping position with respect to the mandrel 170, which supports the grinding wheel 174. The grasping elements 320 may be portions of an automatically operable mechanism, such as a robot or the like. If the dressing roll 76 is to be removed, grasping elements 330 are brought into grasping position, with respect to the mandrel 70 which supports the dressing roll 76, as shown in FIGS. 3 and 5.

Figure 9:
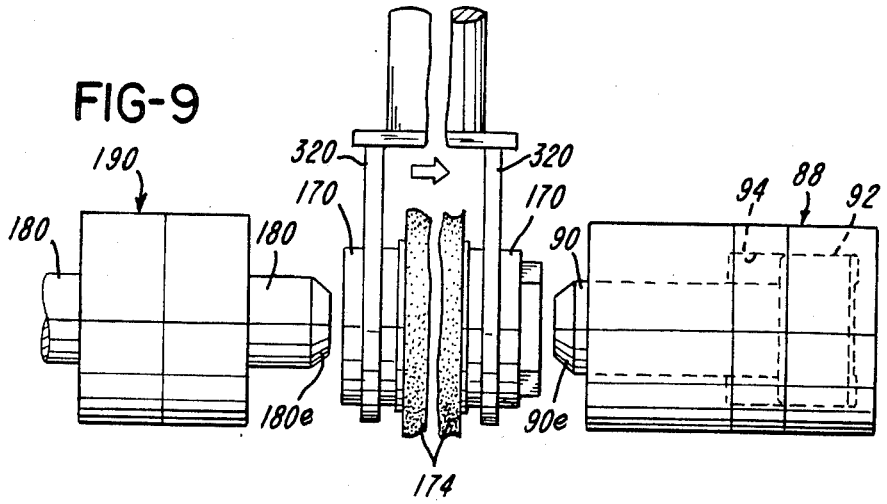
FIG. 9 is a view similar to FIG. 8, with parts shown in elevation and broken away, illustrating another step in removal of the grinding wheel.
Figure 10:
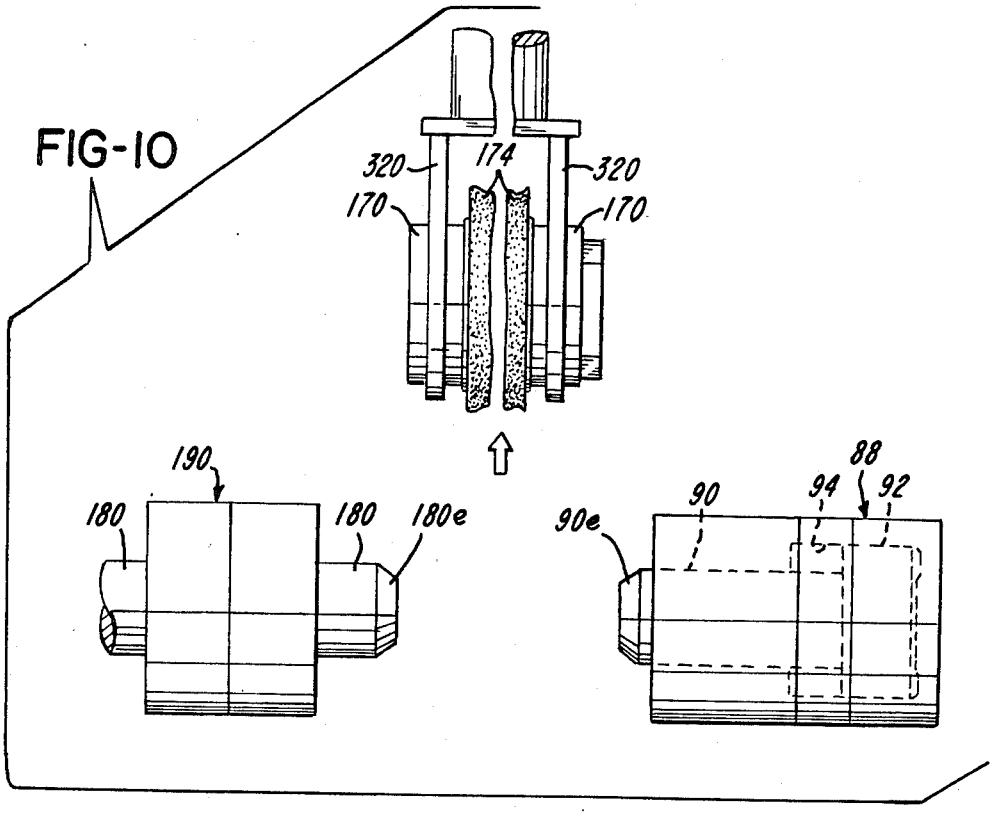
FIG. 10 is a view similar to FIGS. 8 and 9 and illustrating still another step in removal of the grinder wheel for replacement thereof.

Fluid is then forced into the chamber 94 of the bearing housing 88 through the conduit 102 and through the passage 100. Thus, the piston 92 is forced to move in a direction away from the mandrel 170. Thus, the shaft 90 is moved axially from engagement with the mandrel 170, as illustrated in FIG. 8. The sensor element 114 senses that the piston 92 has moved to close relationship to the sensor element 114. Thus, through the conductor 116 and a control unit, not shown, joined to the conductor 116, the grasping elements 320 are automatically operated. Then the grasping elements 320 move the mandrel 170 and the grinding wheel 174 toward the bearing housing 88 in order to remove the mandrel 170 and the grinder wheel 174 from the end portion **180*e* of the shaft 180, as illustrated in FIG. 9. Then the grasping elements 320 lift the mandrel 170 and the grinding wheel 174 upwardly and away from the shafts 180 and 90, as illustrated in FIG. 10**.

The mandrel 70 and the dressing roll 76 can be removed by grasping elements 330 in the same manner as described above for removal of the mandrel 170 and the grinding wheel 174.

The mandrel 170 with the grinding wheel 174 and/or the mandrel 70 with the dressing roll 76 can be moved to the apparatus of this invention and placed into operating positions by movement in substantially the reverse manner from that described above. For example, a grinding wheel 174, upon a mandrel 170, is brought by grasping elements 320 into position between the shafts 180 and 90 as illustrated in FIG. 9. Then the grasping elements 320 move the mandrel 170 and grinding wheel 174 toward the shaft 180, until the mandrel 170 comes into firm engagement with the end portion **180*e* of the shaft 180, as illustrated in FIG. 8. Then fluid is forced into the chamber 94 through the conduit 108 and the passage 106. Thus, the piston 92 is forced to move toward the mandrel 170, and the end portion 90*e* of the shaft 90 is moved into engagement with the mandrel 170. Thus, the mandrel 170 is firmly maintained between the shafts 180 and 90**.

The sensor element 120 senses that the piston 92 is in its position adjacent the sensor element 120. A signal is then transmitted through the conductor 122 to the control unit, not shown, and the control unit moves the grasping members 320 away from the mandrel 170.

Thus, it is understood that this invention provides structure and a method by which a grinding wheel and a dressing roll are operated with extreme accuracy due to the fact that the grinding wheel and dressing roll are each supported by a pair of axially aligned shafts and each of the shafts are supported by hydro-static bearings. Thus, operation of the shafts which support the grinding wheel and dressing roll are not involved in wearing action. Thus, the shafts maintain the grinding wheel and the dressing roll precise positions without runout or the like and maintain very high static and dynamic rigidity.

Also, the structure of this invention provides means and a method by which a grinding wheel and dressing roll can be easily and readily placed into operating position and removed from operating position. Also, the structure of this invention provides means and a method by which a grinding wheel and a dressing roll can be automatically placed into operating position and removed from operating position without manual operation. Mechanical grasping elements may be employed for moving the grinding wheel and the dressing roll into and out of operating positions. Robot type of operation of the grasping elements is possible.

Also, the structure of this invention provides means and a method by which a dressing roll can be automatically maintained in engagement with a grinding wheel by very small infeed increments for continuous dressing of the grinding wheel.

Although the preferred embodiment of the grinding wheel and dressing roll support and release apparatus and method of this invention have been described, it will be understood that within the purview of this invention various changes may be made in the form, details, proportion and arrangement of parts, the combination thereof, and the mode of operation, which generally stated consist in an apparatus and/or method within the scope of the appended claims.

The invention having thus been described, the following is claimed.

1. Grinding apparatus for continuous dressing of a grinding wheel comprising: first support structure, a first bearing housing, the first bearing housing being supported by the first support structure, the first bearing housing including hydrostatic bearing means, a second bearing housing supported by the first support structure, the second bearing housing including hydrostatic bearing means, a first shaft, the first shaft being rotatably supported by the hydrostatic bearing means of the first bearing housing, a second shaft, the second shaft being rotatably supported by the hydrostatic bearing means of the second bearing housing, a piston integrally attached to the second shaft for rotation with the second shaft, the piston having a given axial length, a piston housing encompassing the piston, the piston housing having an internal length significantly greater than the axial length of the piston whereby axial movement of the piston is permitted and whereby the second shaft is axially movable upon the hydrostatic bearing means, fluid conduit means within the second bearing housing for introduction of fluid thereinto for reciprocal axial movement of the piston and the second shaft, the first shaft and the second shaft being in axial alignment, a grinding wheel unit including a grinding wheel, the grinding wheel unit being engaged by the first shaft and the second shaft as the grinding wheel unit is supported by the first shaft and the second shaft and positioned between the first shaft and the second shaft and rotatable wherewith, whereby the grinding wheel unit is removable from the first shaft and the second shaft by axial movement of the piston and the second shaft with fluid forces upon the piston, second support structure adjacent the first support structure, a first dresser shaft, the second support structure including means rotatably supporting the first dresser shaft, the second support structure including hydrostatic bearing means rotatably supporting the second dresser shaft in axial alignment with the first dresser shaft, a dressing wheel unit including a dressing wheel, the dressing wheel unit being in engagement with the first dresser shaft and the second dresser shaft and being positioned between the first dresser shaft and the second dresser shaft and supported thereby, a dresser shaft piston integrally attached to the second dresser shaft and rotatable therewith, the dresser shaft piston having a given axial length, a dresser shaft piston housing encompassing the dresser shaft piston, the dresser shaft piston housing having an internal length which is significantly greater than the axial length of the dresser shaft piston whereby axial movement of the dresser shaft piston and the second shaft is permitted, fluid conduit means within the dresser shaft piston housing for introduction of fluid thereinto for reciprocal axial movement of the dresser shaft piston, whereby the second dresser shaft is axially movable upon the hydrostatic bearing means toward and away from the first dresser shaft for removal of the dressing roll unit from a position between the first dresser shaft and the second dresser shaft and for securing the dressing roll unit between the first dresser shaft and the second dresser shaft, and means for controlled movement of the second support structure toward and away from the first support structure, whereby the dressing wheel is maintained in constant engagement with the grinding wheel during a grinding operation.

2. Grinding apparatus comprising support structure, a first bearing housing supported by the support structure, the first bearing housing including hydrostatic bearing means, a first shaft, the first shaft being rotatably mounted in the first bearing housing and supported by the hydrostatic bearing means thereof, a second bearing housing supported by the support structure, the second bearing housing including hydrostatic bearing means, a second shaft, the second shaft being rotatably mounted in the second bearing housing and supported by the hydrostatic bearing means thereof for rotational and axial movement of the second shaft within the second bearing housing, the first shaft and the second shaft being in axial alignment, the second bearing housing having a chamber therein, a piston attached to the second shaft, the piston being axially movable and rotatable with the second shaft, the piston being positioned within the chamber, means for introducing fluid into the chamber to force axial movement of the piston and the second shaft toward the first shaft, means for introducing fluid into the chamber to force axial movement of the piston and the second shaft in a direction away from the first shaft, and a grinding wheel unit positioned between the first shaft and the second shaft and supported thereby for rotation with the first shaft and the second shaft, the grinding wheel unit including a grinding wheel.

3. The grinding apparatus of claim 2 which includes a carriage movable toward and away from the support structure, a first dresser bearing housing supported upon the carriage, the first dresser bearing housing including hydrostatic bearing means, a second dresser bearing housing supported upon the carriage, the second dresser bearing housing including hydrostatic bearing means, a first dresser shaft, the first dresser shaft being rotatably supported by the hydrostatic bearing means of the first dresser bearing housing, a second dresser shaft, the second dresser shaft being rotatably supported by the hydrostatic bearing means of the second dresser bearing housing, the first dresser shaft and the second dresser shaft being in axial alignment, means within the second dresser bearing housing for axial movement of the second dresser shaft upon the hydrostatic bearing means of the second dresser bearing housing, a dressing roll unit positioned between the first dresser shaft and the second dresser shaft and supported thereby for rotation with the first dresser shaft and the second dresser shaft, the dressing roll unit including a dressing roll, and operation means for movement of the carriage toward and away from the support structure for engagement of the dressing roll with the grinding wheel during operation of the grinding wheel.

4. The grinding apparatus of claim 3 in which the operation means includes control means for moving the carriage toward and away from the support structure for moving the dressing roll toward and away from the grinding wheel for maintaining the dressing roll in engagement with the grinding wheel during a grinding operation.

5. Grinding apparatus comprising a rotatable grinding wheel, a carriage movable toward and away from the grinding wheel, a first dresser bearing housing supported upon the carriage, the first dresser bearing housing including hydrostatic bearing means, a second dresser bearing housing supported upon the carriage, the second bearing housing including hydrostatic bearing means, a first dresser shaft, the first dresser shaft being rotatably supported by the hydrostatic bearing means of the first dresser bearing housing, a second dresser shaft, the second dresser shaft being supported by the hydrostatic bearing means of the second dresser bearing housing for rotational and axial movement of the second dresser shaft with respect to the second dresser bearing housing, the first dresser shaft and the second dresser shaft being in axial alignment, a piston within the second dresser bearing housing and attached to the second dresser shaft for rotational and axial movement therewith, means for introducing fluid into the second dresser bearing housing for axial movement of the piston, whereby the second dresser shaft is axially movable by the piston and upon the hydrostatic bearing means of the second dresser bearing housing, a dressing wheel unit positioned between the first dresser shaft and the second dresser shaft and supported thereby for rotation with the first dresser shaft and the second dresser shaft, the dressing wheel unit including a dressing wheel, operator means operatively joined to the carriage for movement of the carriage toward and away from the grinding wheel, whereby the dressing wheel is maintained in engagement with the grinding wheel for continuous dressing of the grinding wheel, and whereby the dressing wheel is readily positioned between the first dresser shaft and the second dresser shaft and removed therefrom by axial movement of the piston and the second dresser shaft with fluid operation of the piston.

6. The method of support of a grinding wheel unit comprising positioning a pair of shafts in spaced-apart axial alignment, there being a first shaft and a second shaft, supporting each of the shafts upon hydrostatic bearings, providing fluid operable means for axially moving the second shaft upon the hydrostatic bearings, positioning the grinding wheel unit between the pair of shafts with the grinding wheel unit in axial alignment with the pair of shafts and in engagement with the first sahft, axially moving the second shaft into engagement with the grinding wheel unit, and securing the position of said second shaft with respect to the grinding wheel unit for simultaneous rotation of the shafts and the grinding wheel unit.

7. The method of claim 6 which includes attaching a piston to the second shaft for application of fluid thereto for axial movement of the second shaft.

8. The method of claim 6 which includes sensing the axial position of the second shaft and positioning the grinding wheel unit with respect to said pair of shafts in accordance with the axial position of the second shaft.

* * * * *